US007849603B2

(12) United States Patent
Venzon

(10) Patent No.: US 7,849,603 B2
(45) Date of Patent: Dec. 14, 2010

(54) BARBER TOOL

(76) Inventor: Daniel Venzon, 2504 San Marcos Ave., San Diego, CA (US) 92104-5032

( * ) Notice: Subject to any disclaimer, the term of this patent is extended or adjusted under 35 U.S.C. 154(b) by 302 days.

(21) Appl. No.: 11/314,033

(22) Filed: Dec. 20, 2005

(65) Prior Publication Data

US 2007/0137049 A1 Jun. 21, 2007

(51) Int. Cl.
*B26B 13/22* (2006.01)

(52) U.S. Cl. ..... 30/233.5; 30/195

(58) Field of Classification Search ..... 30/233.5, 30/195, 231, 232, 341, 53–55; 132/213.1; D8/57

See application file for complete search history.

(56) References Cited

U.S. PATENT DOCUMENTS

| | | | | | |
|---|---|---|---|---|---|
| 84,860 | A | * | 12/1868 | Craig | 30/233.5 |
| 90,063 | A | * | 5/1869 | Atkinson | 30/233.5 |
| 169,832 | A | * | 11/1875 | Nickelson | 30/233.5 |
| 332,030 | A | * | 12/1885 | Young | 30/233.5 |
| 395,444 | A | * | 1/1889 | Klein | 30/233.5 |
| 482,857 | A | * | 9/1892 | Underwood | 30/233.5 |
| 512,767 | A | * | 1/1894 | Underwood | 30/233.5 |
| 596,213 | A | * | 12/1897 | Loewenthal | 30/226 |
| 628,722 | A | * | 7/1899 | McCarter | 30/233.5 |
| 1,440,015 | A | * | 12/1922 | Kaniefski | 132/148 |
| 1,994,865 | A | * | 3/1935 | Onion | 30/233.5 |
| 2,272,580 | A | * | 2/1942 | Phillips | 30/195 |
| 2,489,168 | A | * | 11/1949 | Tuck | 30/233.5 |
| 2,629,171 | A | * | 2/1953 | Boegehold | 30/233.5 |
| 2,696,043 | A | * | 12/1954 | Maze | 30/233.5 |
| 3,581,934 | A | * | 6/1971 | Sciascia | 221/304 |
| 3,831,277 | A | * | 8/1974 | Nagata | 30/195 |
| 3,972,337 | A | * | 8/1976 | Pomaro | 132/213.1 |
| 4,020,549 | A | | 5/1977 | Edwards | 30/30 |
| D303,919 | S | * | 10/1989 | Pate | D8/57 |
| 5,109,608 | A | | 5/1992 | Pracht | 30/341 |
| 5,131,418 | A | | 7/1992 | Vaccaro | 132/213.1 |
| 5,349,971 | A | | 9/1994 | Player | 132/213.1 |
| 5,377,411 | A | | 1/1995 | Andriotis | 30/133 |
| 5,519,939 | A | | 5/1996 | Smith | 30/30 |
| 5,632,764 | A | * | 5/1997 | Beideman et al. | 606/205 |
| 5,827,029 | A | * | 10/1998 | Denman | 411/373 |
| 5,867,477 | A | * | 2/1999 | Naito et al. | 720/724 |
| D407,527 | S | | 3/1999 | Bellisario | |
| 5,996,592 | A | * | 12/1999 | Choy | 132/200 |
| 6,408,523 | B1 | | 6/2002 | Schmidt | 30/254 |
| 6,457,241 | B1 | | 10/2002 | Droin | 30/232 |
| 6,526,663 | B1 | | 3/2003 | Simmons et al. | 30/233.5 |
| 7,032,316 | B1 | * | 4/2006 | Tseng | 30/230 |

(Continued)

FOREIGN PATENT DOCUMENTS

DE 3638055 A1 * 3/1988

(Continued)

*Primary Examiner*—Jason Daniel Prone
(74) *Attorney, Agent, or Firm*—Sawyer Law Group, P.C.

(57) ABSTRACT

A tool comprising a scissors, the scissors including two handles, each handle including an aperture therethrough is disclosed. The tool includes a comb attached to the scissors. The comb includes a handle portion and a comb portion. The handle portion of the comb includes a plurality of extensions therefrom, the extensions for engaging the aperture of one of the handles of the scissors, wherein the comb can be removed from the scissors by disengaging the extensions.

2 Claims, 9 Drawing Sheets

U.S. PATENT DOCUMENTS

| | | | | |
|---|---|---|---|---|
| 2002/0112352 | A1 | 8/2002 | Droin | 30/254 |
| 2003/0159295 | A1 | 8/2003 | Tapia | 30/175 |
| 2003/0159296 | A1 | 8/2003 | Tapia | 30/175 |
| 2009/0044411 | A1 * | 2/2009 | Cotant | 30/233.5 |

FOREIGN PATENT DOCUMENTS

| | | | | |
|---|---|---|---|---|
| EP | 1413405 | A1 | * | 4/2004 |
| JP | 01227785 | A | * | 9/1989 |
| JP | 05123459 | A | * | 5/1993 |
| JP | 2005288102 | A | * | 10/2005 |
| JP | 2006167410 | A | * | 6/2006 |

* cited by examiner

500

BARBER TOOL

FIELD OF THE INVENTION

The present invention relates generally to combs and scissors and more specifically to a combination comb and scissor tool.

BACKGROUND OF THE INVENTION

Many scissors and combs available today for hair styling are not flexible in positioning in respect to the handle, and do not have replaceable comb scissors and heads. Moreover, when such combs and scissors are used, the user first has to equalize the distance of the hair from the head by measuring it with a comb, then put the comb down and pick up scissors to trim the hair. These actions must be performed repeatedly to equalize and cut the hair, thus contributing to user fatigue, often causing carpal tunnel syndrome, and requiring additional time to go through the repeated movements.

Accordingly, what is needed is a system and method for reducing the number of repetitive movements needed first to equalize the length of the hair to be cut, and then to cut the hair, thereby minimizing user fatigue, minimizing the risk of contracting carpal tunnel syndrome, and reducing the time needed for completing a haircut. The present invention addresses such a need.

SUMMARY OF THE INVENTION

A tool comprising a scissors, the scissors including two handles, each handle including an aperture therethrough is disclosed. The tool includes a comb attached to the scissors. The comb includes a handle portion and a comb portion. The handle portion of the comb includes a plurality of extensions therefrom, the extensions for engaging the aperture of one of the handles of the scissors, wherein the comb can be removed from the scissors by disengaging the extensions.

DETAILED DESCRIPTION

The present invention relates generally to combs and scissors and more specifically to a combination comb and scissor tool.

The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1:
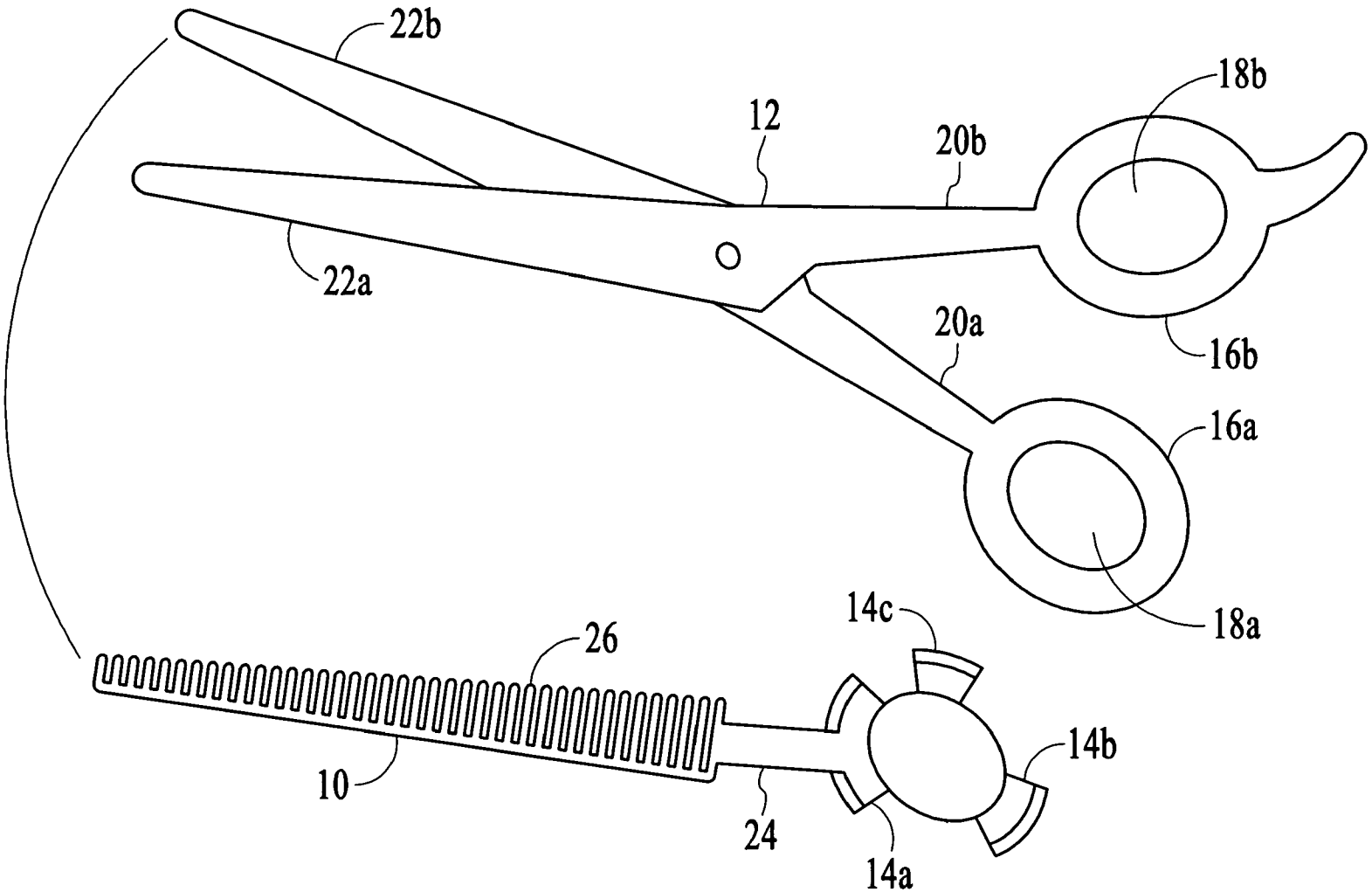
FIG. 1 shows a first embodiment of the present invention.

FIG. 1 shows a first embodiment of the present invention, comprising a comb 10 which clips onto one of the apertures (finger holes) 18*a* and 18*b* of a pair of scissors 12. The scissors 12 comprise handle portions 20*a* and 20*b* and blade portions 22*a* and 22*b*. The handle portions 20*a* and 20*b* include apertures 18*a* and 18*b*, one of which through which the user's finger (not shown) is inserted, depending upon whether the user is left or right handed. The comb 10 comprises a comb portion 26, a handle portion 24, and has a plurality of extensions 14*a*-14*c* on its handle 24 which clip onto one of the handles 16*a* and 16*b* of the scissors 12 through the apertures 18*a* and 18*b* one of which into which the user's finger (not shown) is inserted.

Figure 2:
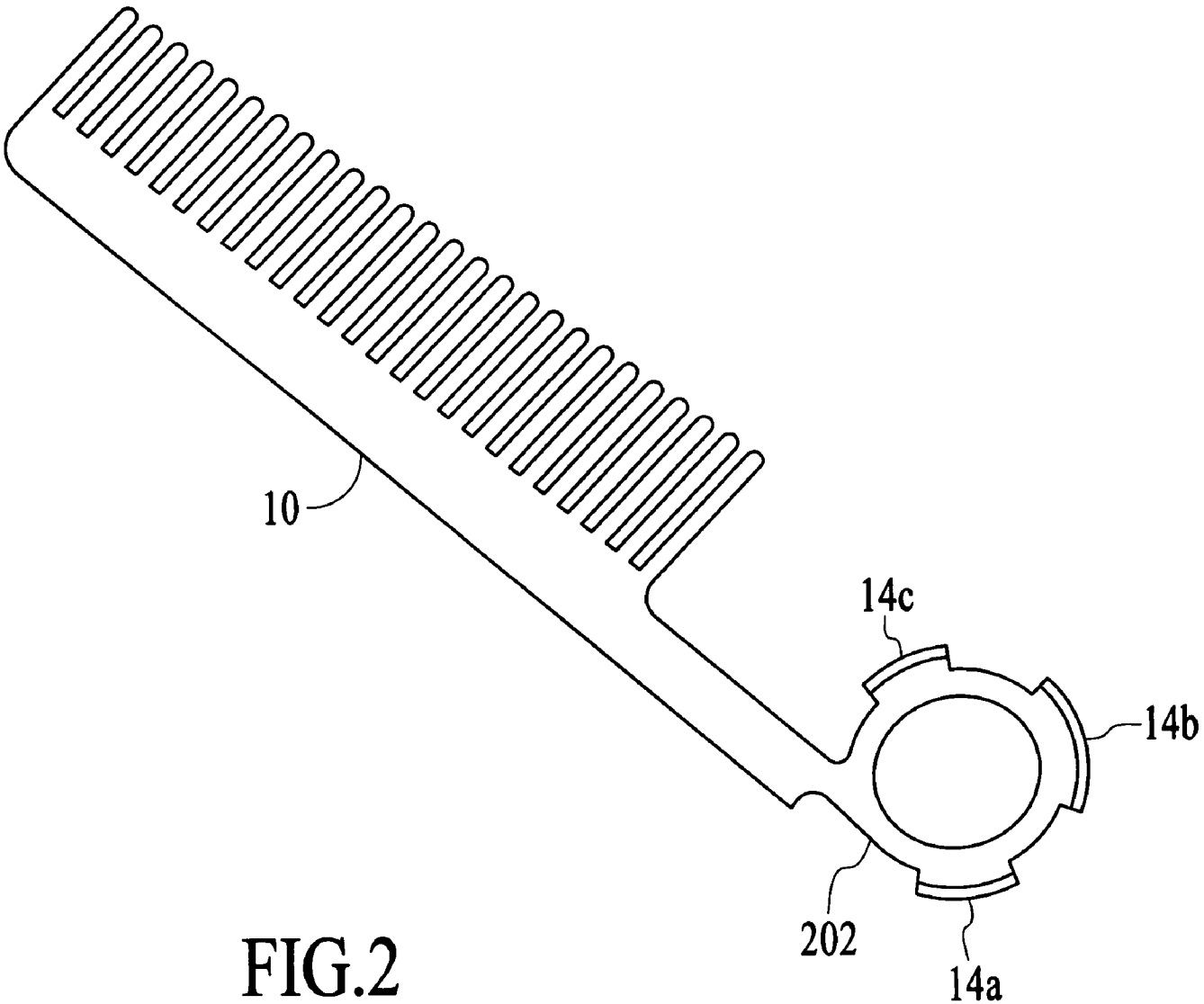
FIG. 2 shows the clip-on comb in accordance with the present invention with extensions on its handle in more detail.

FIG. 2 shows the clip-on comb 10 in accordance with the present invention with extensions 14*a*'-14*c*' on its handle 24 in more detail. The handle 24 comprises a circular-like portion 202 with raised pads 14*a*'-14*c*' thereon. The clip-on comb 10 may be utilized by either a person who is left-handed or a person who is right-handed, since the extensions 14*a*'-14*c*' shown in FIGS. 1 and 2 allow the comb 10 to be attached to either side of the scissors (not shown).

Figure 3:
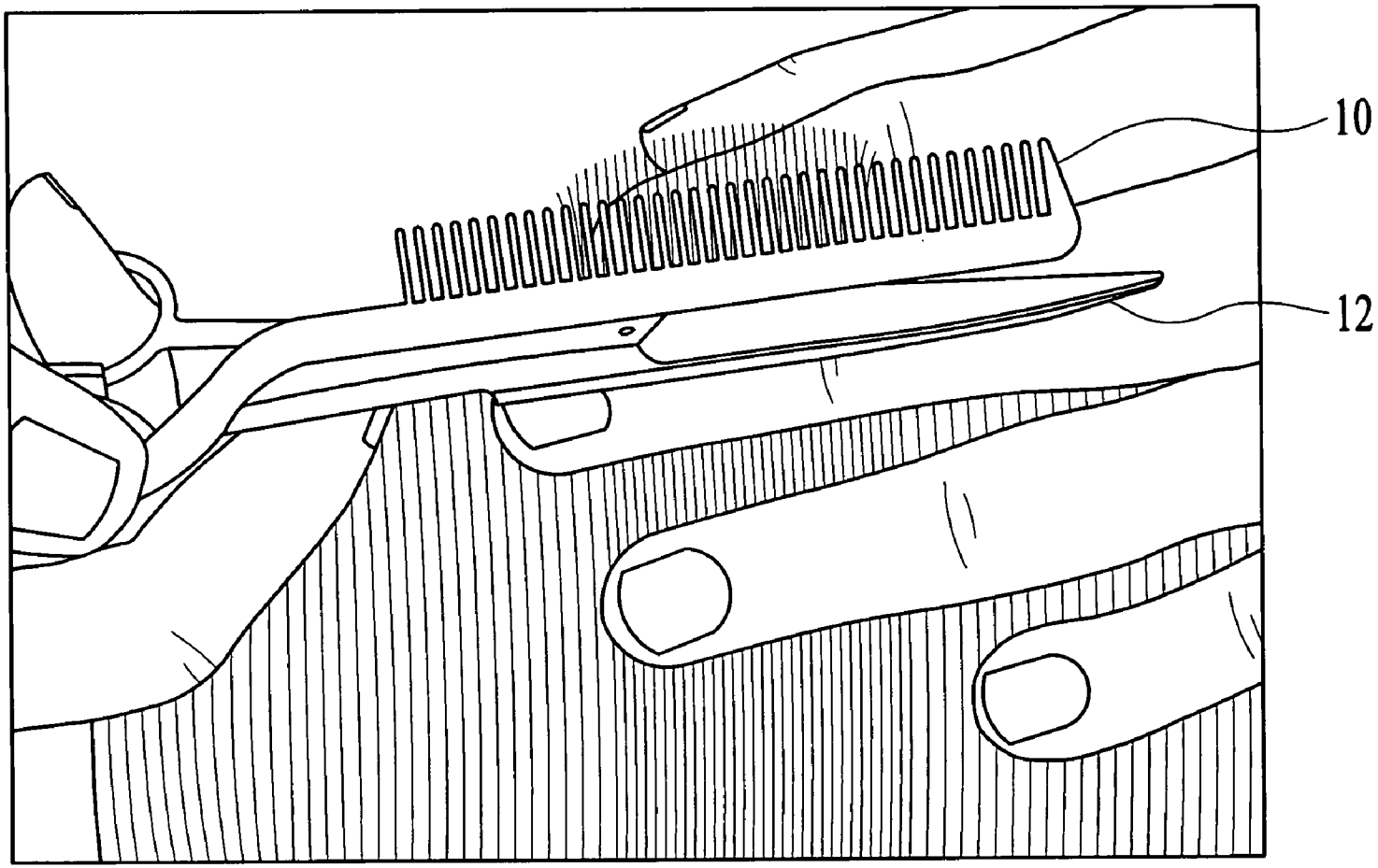
FIG. 3 is a photograph showing measurement of the length of hair to be cut utilizing the comb in accordance with the present invention.

FIG. 3 is a photograph showing measurement of the length of hair to be cut utilizing the comb in accordance with the present invention. When the comb 10 in accordance with the present invention is clipped onto the scissors 12 using the extensions 14*a-c* on its handle as described in FIGS. 1 and 2, the user first measures or equalizes the length of the hair to be cut and then positions the hair with the comb 10. In this way the hair is prepared to be cut.

Figure 4:
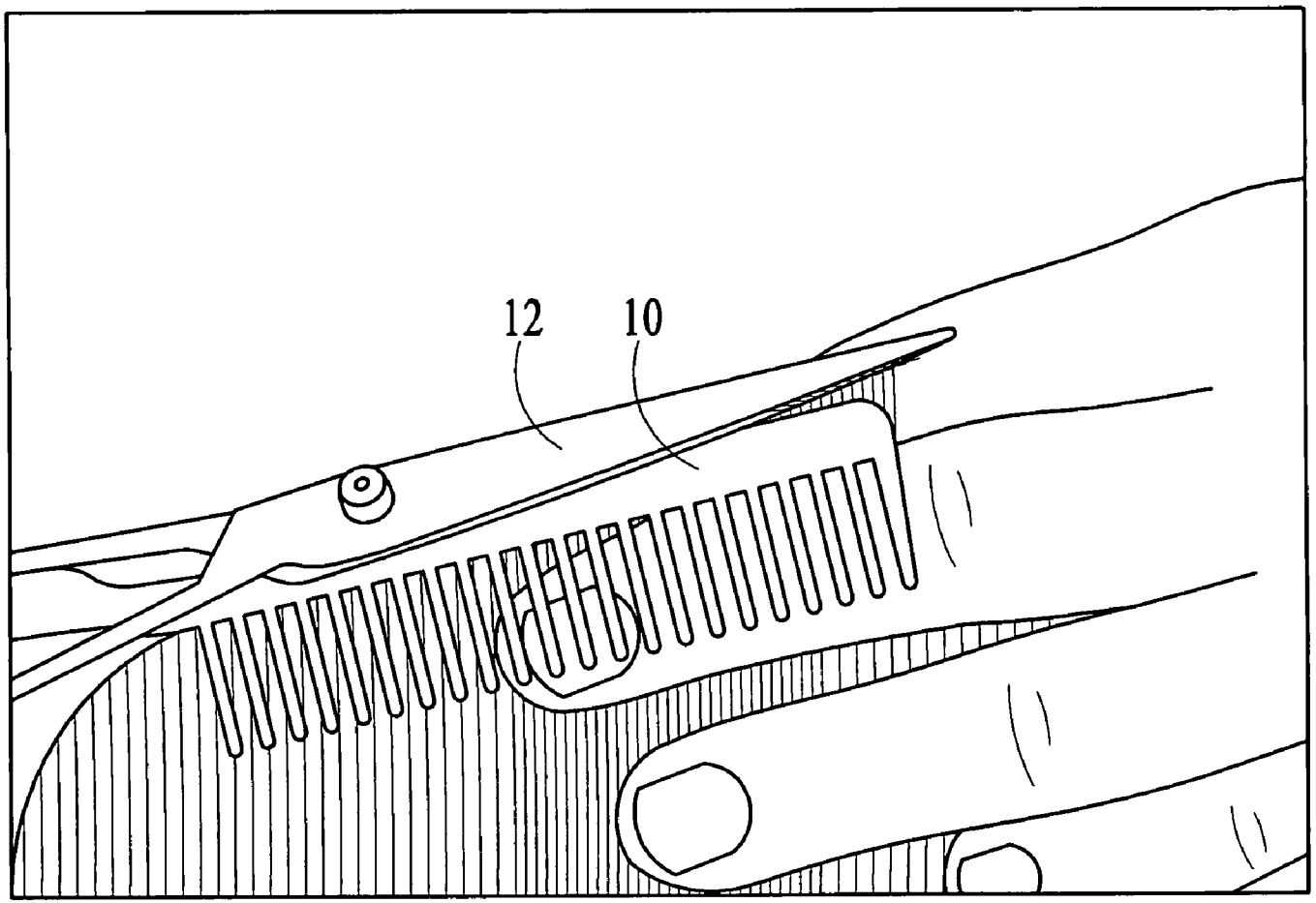
FIG. 4 is a photograph showing cutting of the hair utilizing the comb in accordance with the present invention.

FIG. 4 is a photograph showing cutting of the hair utilizing the comb in accordance with the present invention. After the hair length to be cut is measured, as shown in FIG. 3, the user then moves the comb 10 out of the way or to the side, and cuts the hair with the scissors 12, as shown in FIG. 4.

By utilizing the clip-on comb 10 and scissors 12 combination to cut hair, as shown in FIGS. 3 and 4, time is saved since the user does not need to use a second hand to operate a pair of scissors while holding the comb with the first hand to equalize the length of the hair to be cut and also position the hair.

Figure 5:
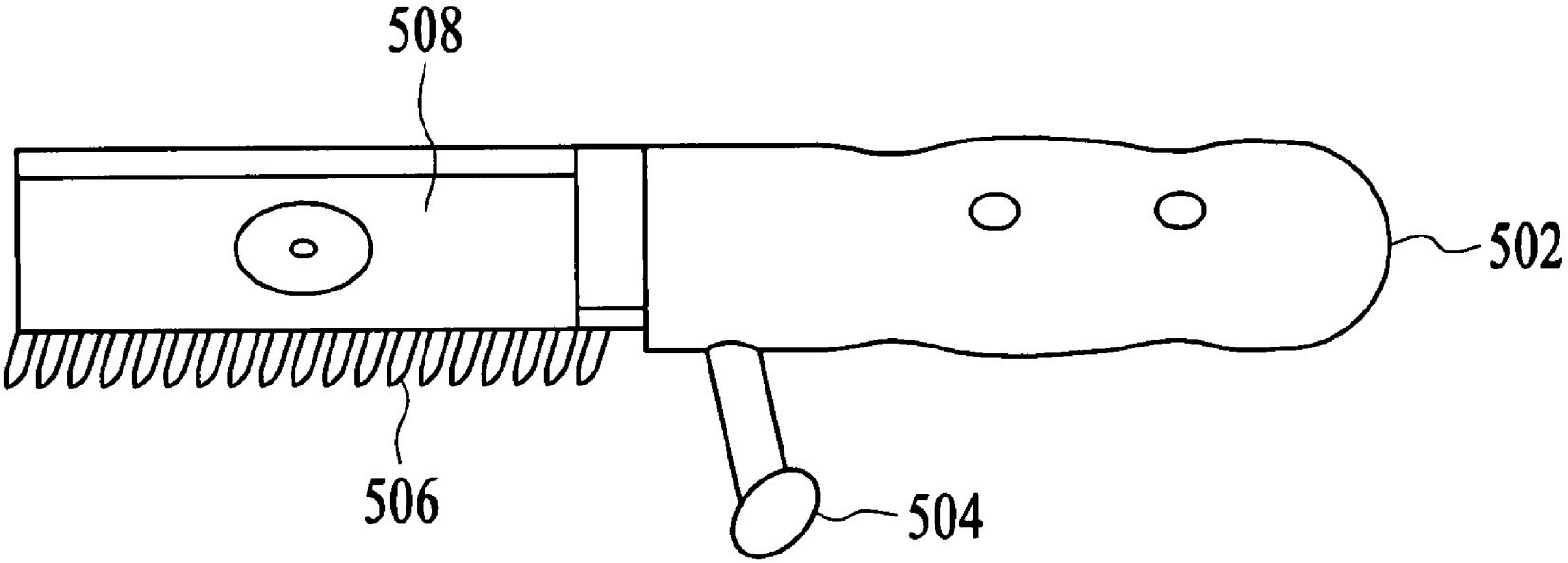
FIG. 5 illustrates a second embodiment of the present invention, comprising a mechanized comb-scissors device/tool/mechanism with a lever.

FIG. 5 illustrates a second embodiment of the present invention, comprising a mechanized comb-scissors device 500 with a lever 504. The device 500 comprises a handle portion 502, a lever 504 with an opening for a finger, a comb 506 and a scissors cutting blade(s) 508.

Figure 6:
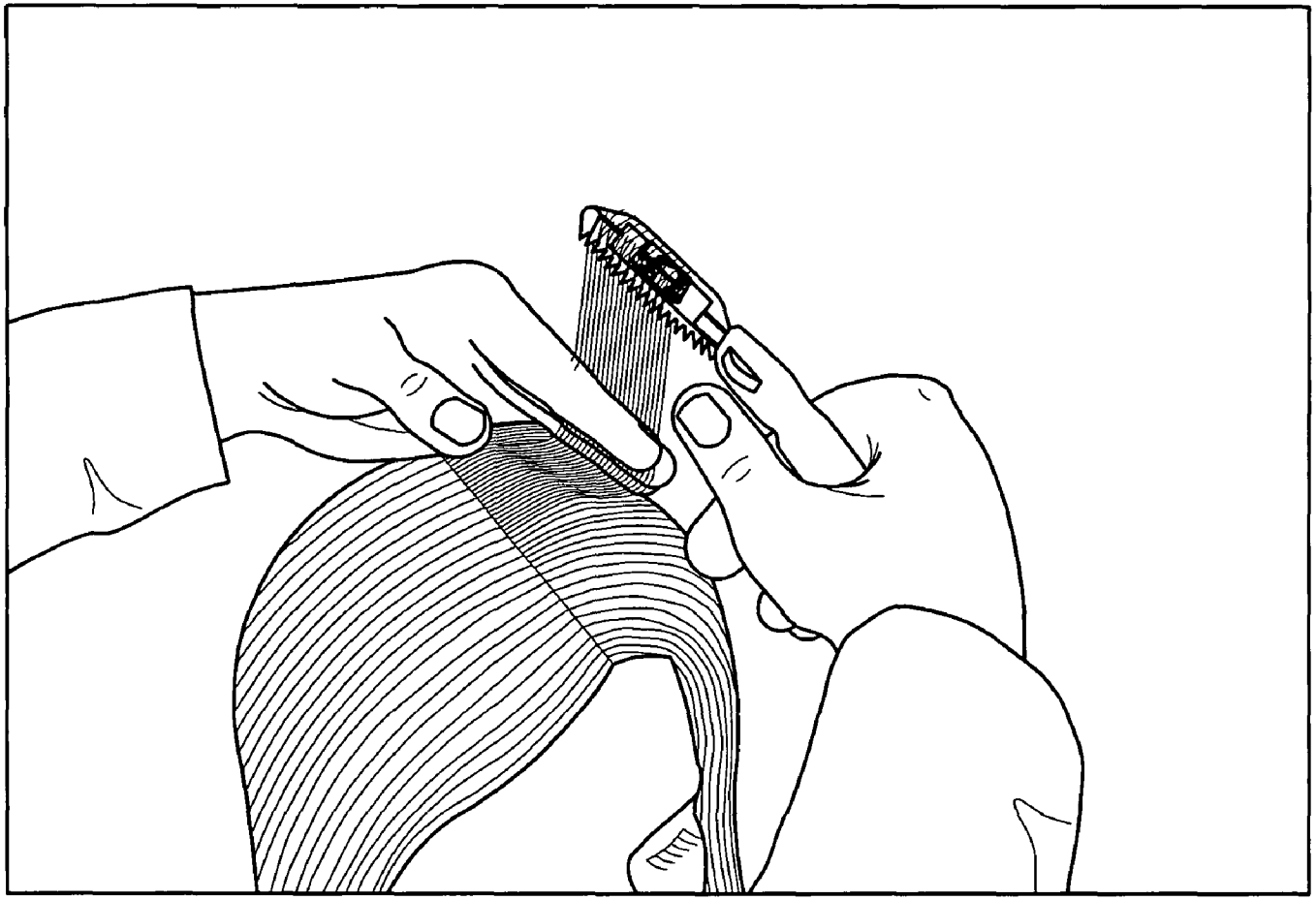
FIG. 6 illustrates the measurement or equalization of hair to be cut.
Figure 7:
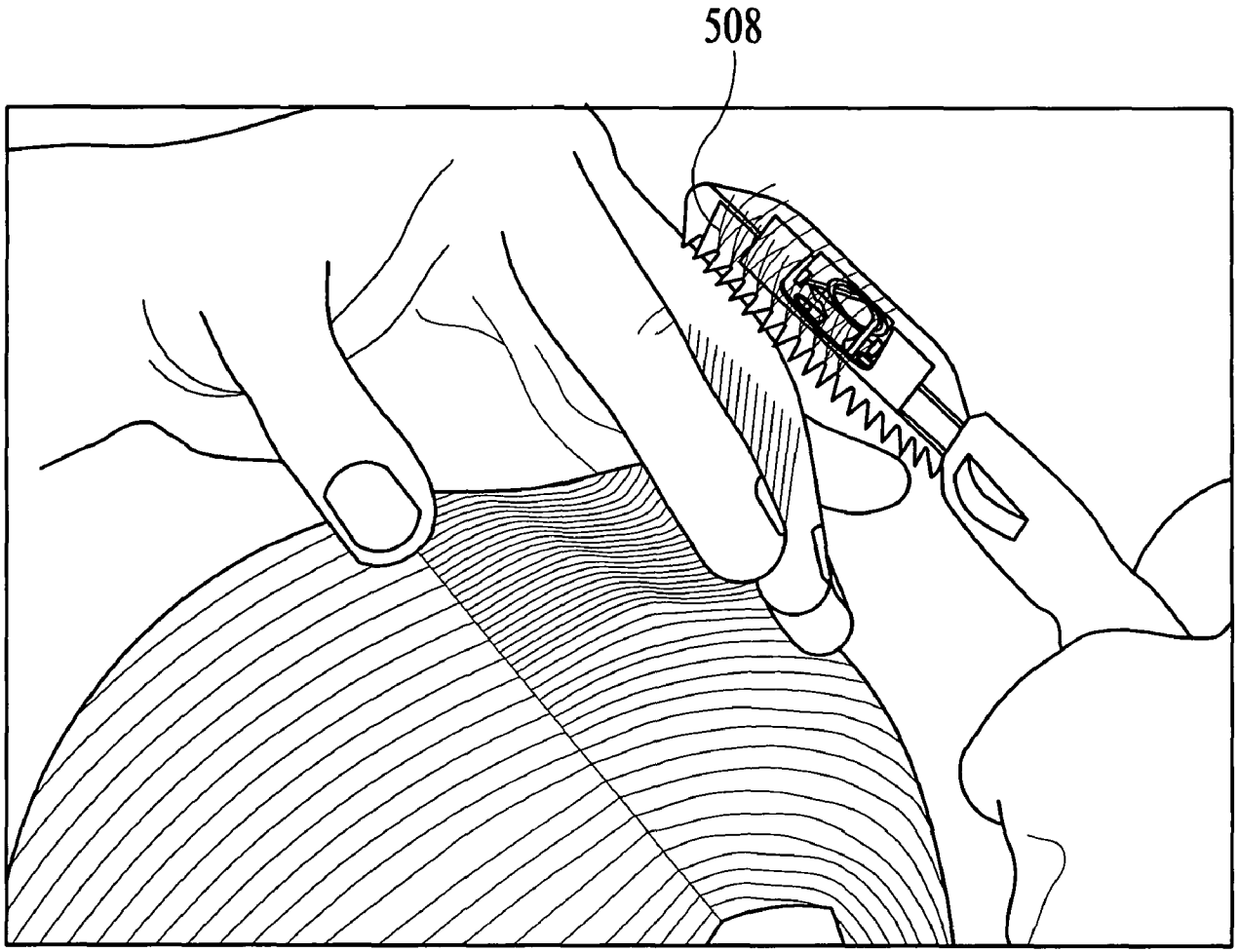
FIG. 7 shows the operation of the second embodiment of the present invention.

In order to cut hair using the device 500, the user first measures or equalizes the length of hair to be cut, as shown in FIG. 6. Referring to FIG. 7, the back-and-forth movement of the lever (not shown) causes a scissors blade(s) 508 to move in such a way as to cut the hair which is being held and positioned by the comb 506, thereby accomplishing both positioning and "equalizing" the length of the hair to be cut via the comb 506 and then cutting the hair with the scissors 508.

Figure 8:
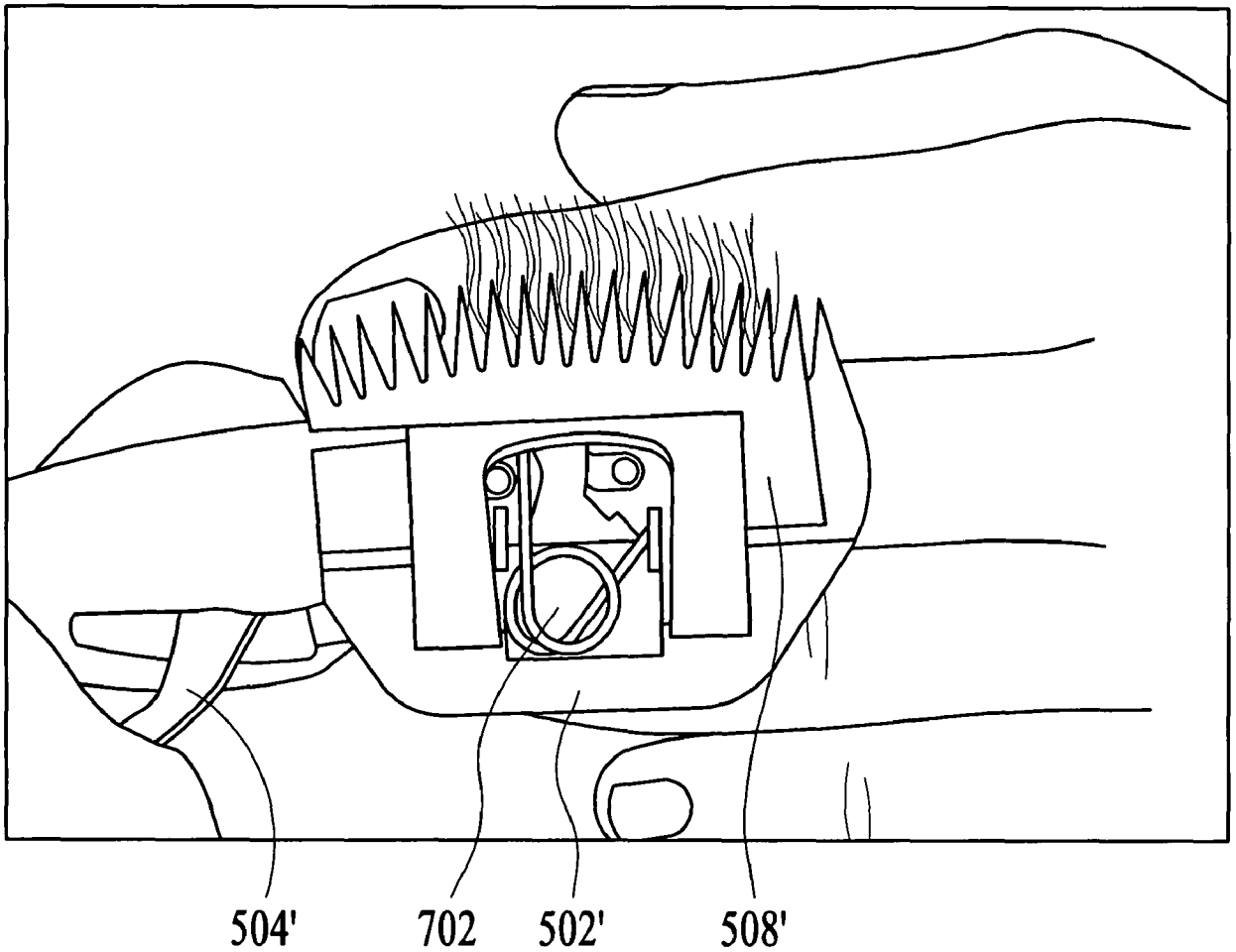
FIG. 8 illustrates an inner cam located inside the handle in the second embodiment of the present invention.

FIG. 8 illustrates an inner cam 702 located inside the handle 502' which links the scissors blade(s) 508' to the lever

504', causing the scissors blade(s) 508' to move up and down to cut the hair as the user moves the lever 504' back and forth with their finger.

Figure 9:
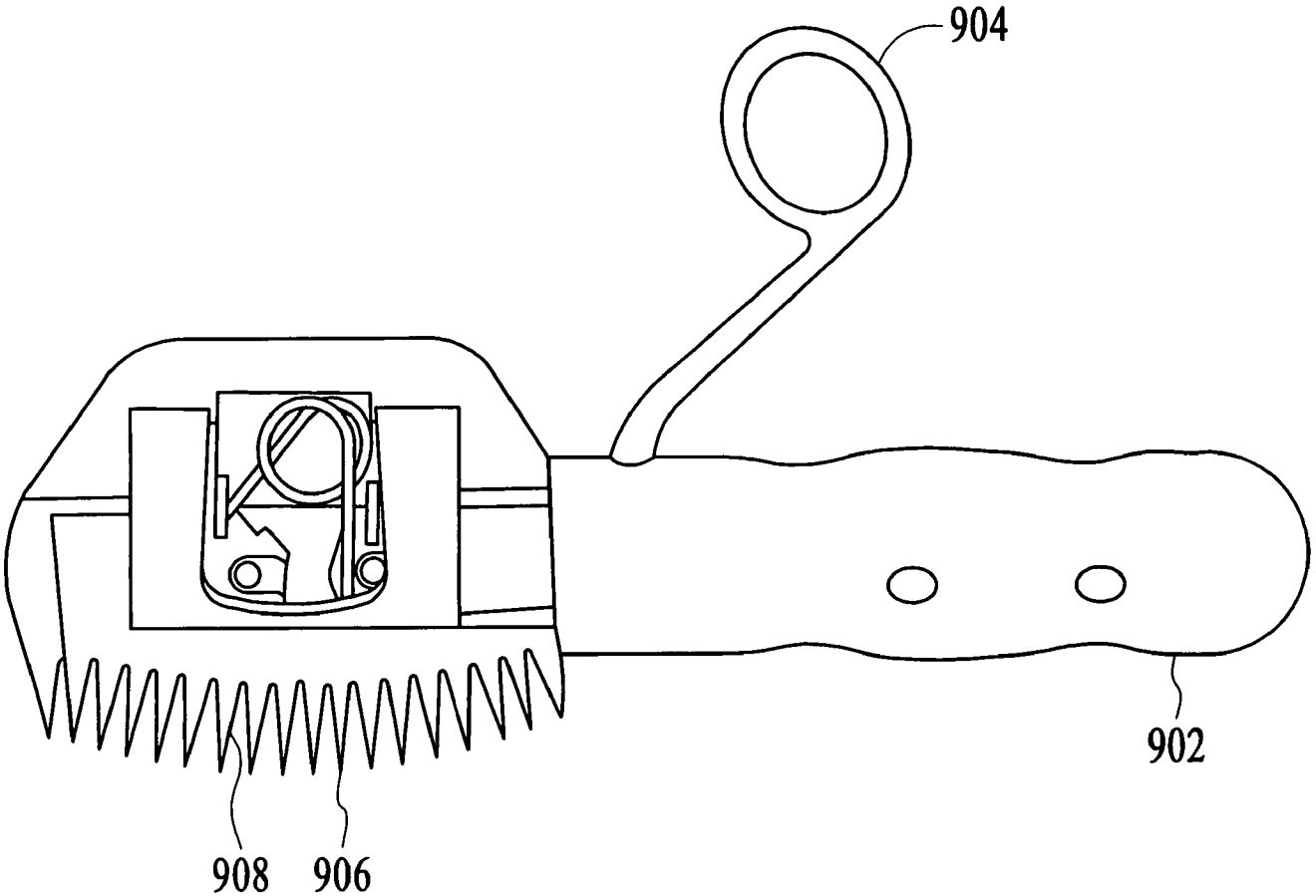
FIG. 9 illustrates a third embodiment of the present invention, comprising a mechanized comb-scissors device with a thumb tab.

FIG. 9 illustrates a third embodiment of the present invention, comprising a mechanized comb-scissors device 900 with a thumb tab 904. The device 900 comprises a handle portion 902, a thumb tab 904, a comb 906 and a scissors cutting blade(s) 908. In this embodiment, the user moves the thumb tab 904 back and forth, thereby causing the scissors cutting blade(s) 908 to move up and down to cut the hair which is being positioned and measured to an "equalized" length by the comb 906.

A person skilled in the art can see that other means by which a user causes the scissors cutting blade(s) to move up and down in combination with a comb to cut the hair would also be within the scope of the present invention.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A tool comprising:

a pair of scissors; the scissors including two handle portions with blade portions attached thereto, each of said handle portions include a finger hole therethrough; and a comb, the comb including a handle and a comb portion, the handle comprising a circular-opening including a plurality of extensions therefrom, wherein the extensions comprise a plurality of raised pads with rounded outer edges around the periphery of the circular opening wherein the rounded outer edges of the raised pads conform to the circular opening to engage an interior portion of the finger hole of one of the handle portions of the scissors, wherein the raised pads engageably couple the handle of the comb to the scissors, wherein the comb can be removed from the scissors by disengaging the extensions with the use of only one of a user's hands.

2. The tool of claim 1 wherein the comb can be attached to either of said handle portions or either side of the scissors.

* * * * *